US009957738B2

(12) United States Patent
Muramatsu et al.

(10) Patent No.: US 9,957,738 B2
(45) Date of Patent: May 1, 2018

(54) FIXING DEVICE FOR VEHICLE DOORS

(71) Applicant: AISIN SEIKI KABUSHIKI KAISHA, Kariya-shi, Aichi-ken (JP)

(72) Inventors: Akira Muramatsu, Chiryu (JP); Kosuke Tsukamoto, Anjo (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 230 days.

(21) Appl. No.: 14/652,034

(22) PCT Filed: Dec. 6, 2013

(86) PCT No.: PCT/JP2013/082820

§ 371 (c)(1),
(2) Date: Jun. 12, 2015

(87) PCT Pub. No.: WO2014/097902

PCT Pub. Date: Jun. 26, 2014

(65) Prior Publication Data

US 2015/0322700 A1 Nov. 12, 2015

(30) Foreign Application Priority Data

Dec. 21, 2012 (JP) ..... 2012-280214

(51) Int. Cl.
*E05B 15/02* (2006.01)
*E05B 85/04* (2014.01)
(Continued)

(52) U.S. Cl.
CPC ..... *E05B 85/045* (2013.01); *E05B 77/36* (2013.01); *E05B 81/02* (2013.01); *E05B 81/18* (2013.01);
(Continued)

(58) Field of Classification Search
CPC ..... E05B 85/045; E05B 77/36
(Continued)

(56) References Cited

U.S. PATENT DOCUMENTS 1,888,829 A * 11/1932 Moore ..... E05F 7/04 16/85
1,893,639 A * 1/1933 Stutson ..... E05F 7/005 16/86 B
(Continued)

FOREIGN PATENT DOCUMENTS

EP 1 186 738 A2 3/2002
JP 2012-149502 A 8/2012

OTHER PUBLICATIONS

Extended European Search Report dated Feb. 19, 2016, issued by the European Patent Office in the corresponding European Application No. 13865657.4. (5 pages).
(Continued)

*Primary Examiner* — Carlos Lugo
(74) *Attorney, Agent, or Firm* — Buchannan Ingersoll & Rooney PC

(57) ABSTRACT

A fixing device for vehicle doors includes a door lock striker, a fixed member, and a movable member. The fixed member has two inclined surfaces that are movable relative to the door lock striker and located on opposite sides of the door lock striker. The movable member has two inclined surfaces arranged on opposite sides of the door lock striker and is urged such that each inclined surface is pushed against the corresponding inclined surface of the fixed member. The door lock striker includes a leg portion. The movable member includes two bodies forming the two inclined surfaces of the movable member, and a connecting portion that connects the bodies at the rear end portions of the bodies, which are pressed towards the fixed member and
(Continued)

moved rearward. The connecting portion has an arched shape that protrudes in the protruding direction of the leg portion.

13 Claims, 7 Drawing Sheets

(51) Int. Cl.

| | |
|---|---|
| ***E05C 1/08*** | (2006.01) |
| ***E05B 85/22*** | (2014.01) |
| ***E05B 81/02*** | (2014.01) |
| ***E05B 81/18*** | (2014.01) |
| ***E05B 77/36*** | (2014.01) |
| *E05B 15/00* | (2006.01) |

(52) U.S. Cl.
CPC ..... *E05B 85/22* (2013.01); *E05C 1/08* (2013.01); *Y10T 292/0976* (2015.04); *Y10T 292/1016* (2015.04)

(58) Field of Classification Search
USPC ..... 292/340, 342, 343
See application file for complete search history.

(56) References Cited

U.S. PATENT DOCUMENTS 1,903,365 A * 4/1933 Haskins ..... E05F 5/025 16/85
2,187,530 A * 1/1940 Butler ..... E05B 15/0245 16/85
4,165,112 A * 8/1979 Kleefeldt ..... E05B 85/045 292/216
4,192,039 A * 3/1980 Haberle ..... B60J 5/101 16/86 B
5,069,491 A * 12/1991 Weinerman ..... E05B 77/265 292/216
5,992,927 A * 11/1999 Scroggie ..... B60J 5/00 16/85
6,676,201 B2 * 1/2004 Im ..... B60J 5/101 16/82
7,029,043 B2 * 4/2006 Fisher ..... E05B 15/0006 292/341.13
7,681,281 B2 * 3/2010 Schubring ..... E05F 7/04 16/86 B
8,439,409 B2 * 5/2013 Uto ..... E02F 9/00 292/200
D689,757 S * 9/2013 Mukaide ..... D8/343
8,534,745 B1 * 9/2013 Quinn ..... E05B 77/38 292/340
8,616,612 B2 * 12/2013 Quinn ..... E05B 77/38 292/340
D709,352 S * 7/2014 Inoue ..... D8/343
D712,719 S * 9/2014 Inoue ..... D8/343
9,121,205 B2 * 9/2015 Muramatsu ..... E05B 77/36
2002/0000727 A1 * 1/2002 Rass ..... E05B 85/045 292/216
2006/0244286 A1 * 11/2006 Meyers ..... E05F 7/04 296/146.1
2010/0219648 A1 * 9/2010 Watson ..... E05F 7/005 292/343
2012/0112474 A1 * 5/2012 Muramatsu ..... E05B 77/36 292/164
2012/0112477 A1 * 5/2012 Muramatsu ..... E05B 77/36 292/340
2012/0161454 A1 6/2012 Muramatsu et al.
2012/0311819 A1 * 12/2012 Muramatsu ..... E05B 85/045 16/82
2013/0047374 A1 * 2/2013 Muramatsu ..... E05B 77/36 16/82
2014/0070546 A1 3/2014 Muramatsu et al.

OTHER PUBLICATIONS

International Preliminary Report on Patentability (Form PCT/IB/373) and the Written Opinion of the International Searching Authority (From PCT/ISA/237) dated Jun. 25, 2015, by the international Bureau of WIPO in corresponding International Application No. PCT/JP2013/082820. (4 pages).
Notification of Transmittal of Translation of the International Preliminary Report on Patentability (Forms PCT/IB/338 and PCT/IB/373) and the Written Opinion of the International Searching Authority (Form PCT/ISA/237) dated Aug. 11, 2015, by the International Bureau of WIPO in corresponding International Application No. PCT/JP2013/052925. (8 pages).
International Search Report (PCT/ISA/210) dated Feb. 25, 2014, by the Japanese Patent Office as the International Searching Authority for International Application No. PCT/JP2013/082820.

* cited by examiner

FIXING DEVICE FOR VEHICLE DOORS

TECHNICAL FIELD

The present invention relates to a fixing device for vehicle doors.

BACKGROUND ART

A conventional fixing device for vehicle doors includes two members, which are arranged on a vehicle body panel and a door panel such that an inclined surface of one of the members comes into contact with a corresponding inclined surface of the other one of the members when the vehicle door is closed. The fixing device is adapted to urge and press one of the members (a movable member) against the other one of the members (a fixed member). See, for example, Patent Document 1.

That is, using the force by which the members are pressed against each other, the vehicle door in the closed state is pressed in a direction crossing the opening and closing direction of the vehicle door, or, for example, against the hinge portion, which is the motion pivot of the door. In this manner, backlash of the vehicle door is restrained through a simple configuration.

PRIOR ART DOCUMENTS

Patent Documents

Patent Document 1: Japanese Laid-Open Patent Publication No. 2012-149502

SUMMARY OF THE INVENTION

Problems that the Invention is to Solve

However, vehicle body panels and door panels are shaped differently from one type of vehicles to another. For example, typically, smaller vehicles have doors with smaller thicknesses. To widen the usability of a vehicle door fixing device such that the device can be used in such smaller vehicles, areas necessary for installing members must be reduced in size. The areas must be reduced in size particularly in directions in which the members are moved relative to each other when the vehicle door is opened or closed. In this regard, further improvement of vehicle door fixing devices has been desired.

Accordingly, it is an objective of the present invention to provide a widely usable fixing device for vehicle doors that requires relatively small areas for installing members.

Means for Solving the Problems

To achieve the foregoing objective and in accordance with one aspect of the present invention, a fixing device for vehicle doors is provided that includes a door lock striker adapted to be arranged on a first panel that is one of a vehicle body panel and a door panel, a fixed member, and a movable member. The fixed member is adapted to be fixed to a second panel that is the other one of the vehicle body panel and the door panel. The fixed member has two inclined surfaces that are movable relative to the door lock striker on opposite sides of the door lock striker. The movable member is adapted to be arranged on the first panel. The movable member has two inclined surfaces arranged on opposite sides of the door lock striker, and the inclined surfaces are urged to be pressed against the inclined surfaces of the fixed member. The door lock striker includes a leg portion projected from a panel surface of the first panel. The movable member includes two bodies configuring the two inclined surfaces of the movable member and a connecting portion that connects the bodies together at rear end portions of the bodies that are pressed against the fixed member and moved rearward. The connecting portion has an arched shape protruding in a direction in which the leg portion is projected.

The connecting portion connects the two bodies together at the rear end portions of the bodies. The connecting portion is moved forward or rearward in the front-rear direction integrally with the bodies at a position rearward of the leg portion of the door lock striker, which is projected from one of the panel surfaces. In many cases, the basal end portion of each leg portion of the door lock striker includes protruding portions such as a fixing portion of the leg portion and a guide portion of the movable member. The movement range of the movable member is set relatively rearward to restrain interference between the connecting portion and the protruding portions when the movable member is moved forward. This disadvantageously enlarges the area necessary for installing the movable member on the corresponding one of the panel surfaces.

However, in the above-described configuration, even when the movable member is moved forward, it is unlikely that the connecting portion will interfere with the protruding portions, which are formed in the basal end portion of the leg portion of the door lock striker. This allows the movement range of the movable member to be set relatively forward, thus reducing the size of the area necessary for installing the movable member. As a result, the usability of the device is widened so that the device can be used in a greater number of types of vehicles.

MODES FOR CARRYING OUT THE INVENTION

One embodiment of the present invention will now be described with reference to the drawings.

Figure 1:
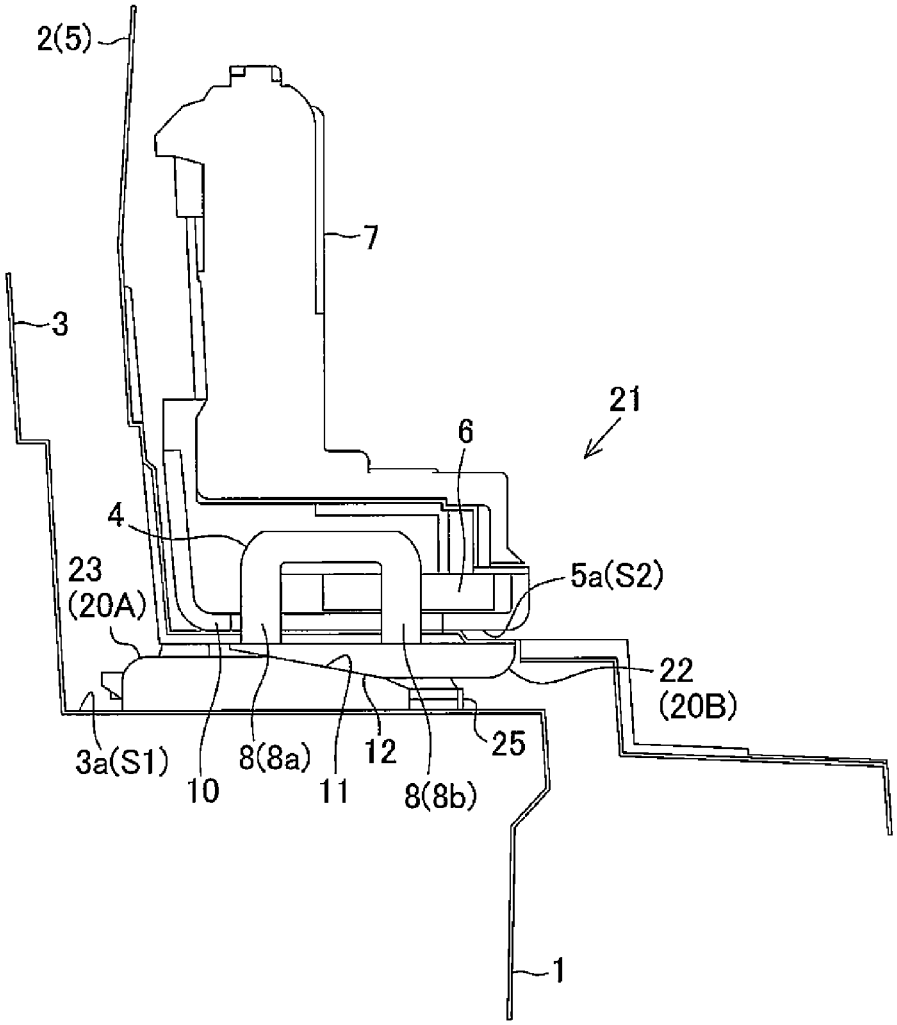
FIG. 1 is a diagram schematically showing a vehicle door fixing device.

As shown in FIG. 1, in a vehicle body panel (a side member outer panel) 1, which configures a side surface of a vehicle, a door lock striker 4 having a substantially U-shaped outline and protruding from a panel surface S1 is arranged on a side end face 3*a* of a door opening 3, to which a vehicle door 2 is attached. A door lock assembly 7 having a publicly known latch mechanism 6 is arranged on a door panel (a door inner panel) 5, which is a component of a vehicle door 2. When the vehicle door 2 is selectively opened or closed, the door lock striker 4 becomes engaged with or separate from the latch mechanism 6. The vehicle body panel 1 corresponds to a first panel and the door panel 5 corresponds to a second panel. In the above illustrated embodiment, the vehicle door 2 is fixed in a closed state through engagement between the latch mechanism 6 and the door lock striker 4.

Specifically, the vehicle door 2, which is illustrated in FIG. 1, is a right side door of the vehicle, which is selectively opened and closed about a hinge portion (not shown) serving as the action pivot. The hinge portion is arranged on the side end face on the front side of the door opening 3 (the upper side as viewed in the drawing). The door lock striker 4 is fixed to the side end face 3*a* of the door opening 3. The door lock striker 4 has two leg portions 8 (8*a*, 8*b*) projected from the panel surface S1. The leg portions 8 (8*a*, 8*b*) are arranged on a line substantially coinciding with the movement path of the door panel 5, which is moved as the vehicle door 2 is selectively opened and closed. The movement direction of the door panel 5 corresponds to each lateral direction of the vehicle, which is the horizontal direction as viewed in FIG. 1.

In the present embodiment, a side end face 5*a* of the door panel 5, which is arranged on the rear side, is located at the position facing the side end face 3*a* of the door opening 3 when the vehicle door 2 is closed. The door panel 5 has a striker hole 10, which extends in the direction (the horizontal direction as viewed in FIG. 1) in which the door panel 5 moves relative to the door lock striker 4.

That is, in the present embodiment, the door lock striker 4, which is arranged on the vehicle body panel 1, is adapted to be apparently received by or separated from the striker hole 10, which is formed in the panel surface S2 of the door panel 5, by being moved relatively in correspondence with opening/closing of the vehicle door 2. The door lock assembly 7 is fixed to the inner side of the door panel 5 (the inside of the panel) such that the latch mechanism 6 is arranged at a position facing the striker hole 10.

A member 20A and a member 20B are arranged on the panel surface S1 of the vehicle body panel 1 and the panel surface S2 of the door panel 5, respectively. Two inclined surfaces 11 of the member 20A come into contact with two inclined surfaces 12 of the member 20B when the vehicle door 2 is closed. In the present embodiment, a vehicle door fixing device 21 is formed in this manner. Using the forces by which the members 20A, 20B are pressed against each other, the vehicle door fixing device 21 presses the vehicle door 2, which is closed, in a direction crossing the opening/closing direction of the vehicle door 2, more specifically, toward the vehicle front side (the upper side as viewed in FIG. 1), on which the hinge portion serving as the motion pivot of the vehicle door 2 is arranged.

Specifically, in the present embodiment, the member 20B of the door panel 5 is a fixed member 22, which has the inclined surfaces 12 arranged on the leading side in the closing direction of the vehicle door 2 (leftward as viewed in FIG. 1) and is fixed to the panel surface S2. On the other hand, the member 20A of the vehicle body panel 1 is configured as a movable member 23, which is movable in the direction in which the fixed member 22 is moved relatively in correspondence with opening/closing of the vehicle door 2. The movable member 23 (the member 20A) is urged such that the inclined surfaces 11 of the movable member 23 are pressed against the inclined surfaces 12 of the fixed member 22.

Figure 2:
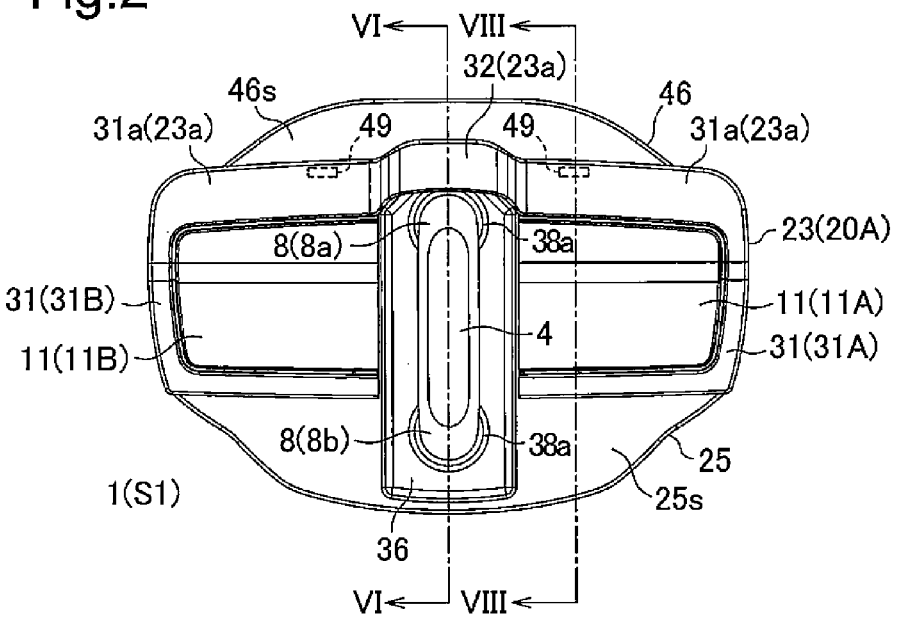
FIG. 2 is a plan view showing a door lock striker, a movable member, a base plate, and a coil cover arranged on a vehicle body panel.
Figure 3:
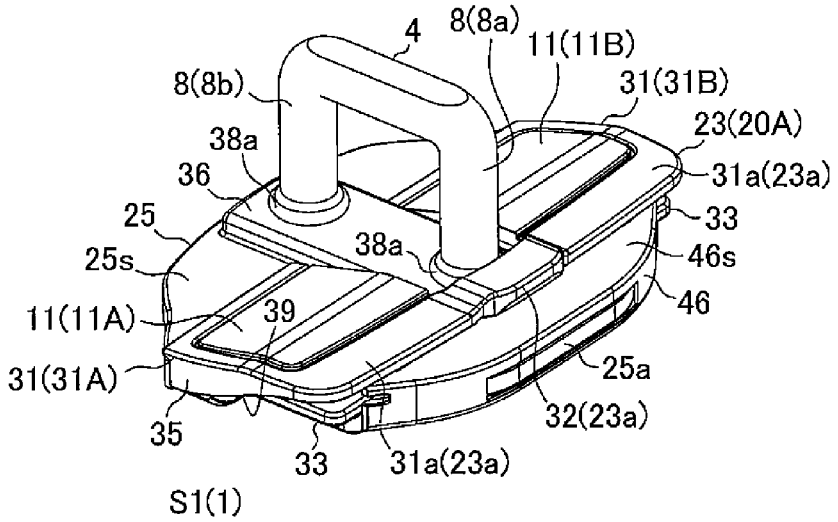
FIG. 3 is a perspective view showing the door lock striker, the movable member, the base plate, and the coil cover arranged on the vehicle body panel.

More specifically, referring to FIGS. 2 and 3, the door lock striker 4 of the present embodiment is projected from a base plate 25, which is fixed to the panel surface S1 of the vehicle body panel 1. Specifically, when the door lock striker 4 is fixed to the vehicle body panel 1, the direction of a line that connects the two leg portions 8 (8*a*, 8*b*) of the door lock striker 4 (the vertical direction as viewed in FIG. 2) and the direction perpendicular to this direction (the horizontal direction as viewed in the drawing) are defined as "the front-rear direction" and "the widthwise direction", respectively, of the base plate 25. In this case, the door lock striker 4 is arranged at a middle position of the base plate 25 in the widthwise direction.

Figure 4:
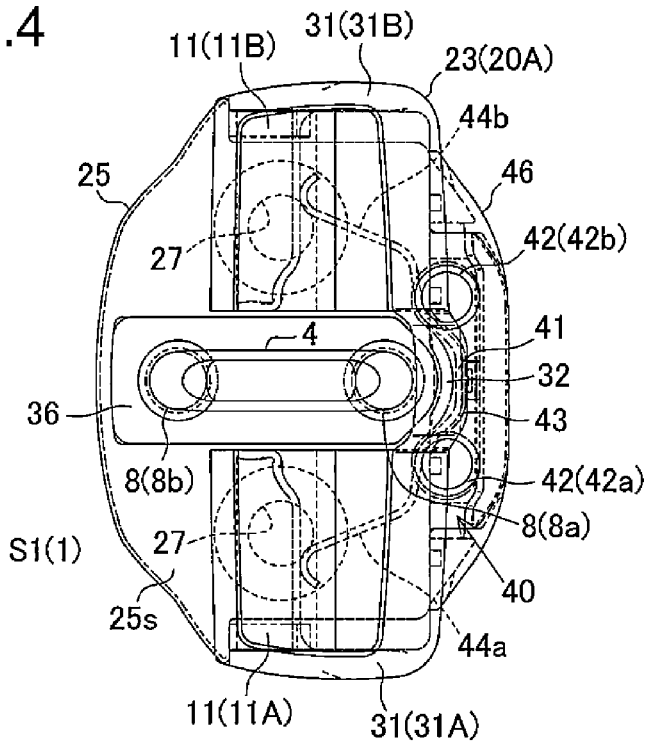
FIG. 4 is a plan view showing the base plate and the coil cover, representing the relationship between the position of a torsion coil spring for urging the movable member and the position of the door lock striker.

As shown in FIG. 4, the base plate 25 has bolt holes 27, which extend through the base plate 25 in the thickness direction. In the present embodiment, the base plate 25 is fastened to the panel surface S1 of the vehicle body panel 1 using fastening force of bolts (not shown), which are inserted through the bolt holes 27.

With reference to FIGS. 2 and 3, the movable member 23 of the present embodiment has the two inclined surfaces 11 (11A, 11B), which are arranged on opposite sides of the door lock striker 4 in the widthwise direction of the base plate 25. The movable member 23 is arranged on the base plate 25 to be slidable in the front-rear direction.

Specifically, in the present embodiment, the movable member 23 includes two bodies 31 (31A, 31B), each of which forms the corresponding one of the inclined surfaces 11 (11A and 11B), and a connecting portion 32, which connects the bodies 31 to each other through rear end portions 31*a* of the bodies 31. The movable member 23 of the present embodiment is a molded product (an injection-molded product) of plastic, in which the bodies 31 and the connecting portion 32 are formed as an integral body using a mold. The movable member 23 of the embodiment is attached to the base plate 25 with the door lock striker 4 arranged between the two bodies 31.

Figure 5:
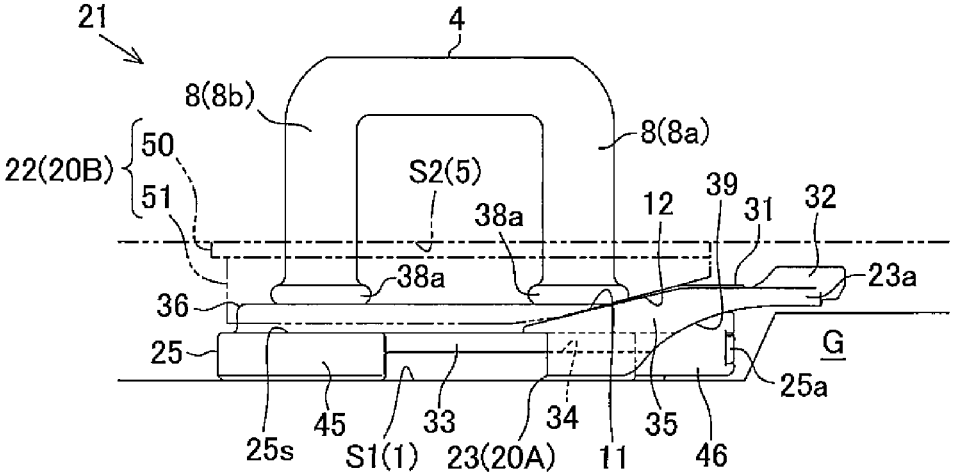
FIG. 5 is a side view showing the door lock striker, the movable member, the base plate, and the coil cover arranged on the vehicle body panel.

More specifically, as illustrated in FIG. 5, in the present embodiment, guide rails 33, each of which extends in the front-rear direction of the base plate 25, are formed at opposite ends of the base plate 25 in the widthwise direction. The movable member 23 includes two side wall portions 35, each of which has a guide groove 34 engaged with the corresponding one of the guide rails 33 and are arranged on opposite sides of the base plate 25 in the widthwise direction. In the present embodiment, engagement between the guide grooves 34 of the two side wall portions 35 and the guide rails 33 of the base plate 25 enables the movable member 23 to slide in the front-rear direction on a flat surface 25*s* (the upper surface as viewed in FIG. 5), which faces in the projecting direction of the door lock striker 4.

Figure 6:
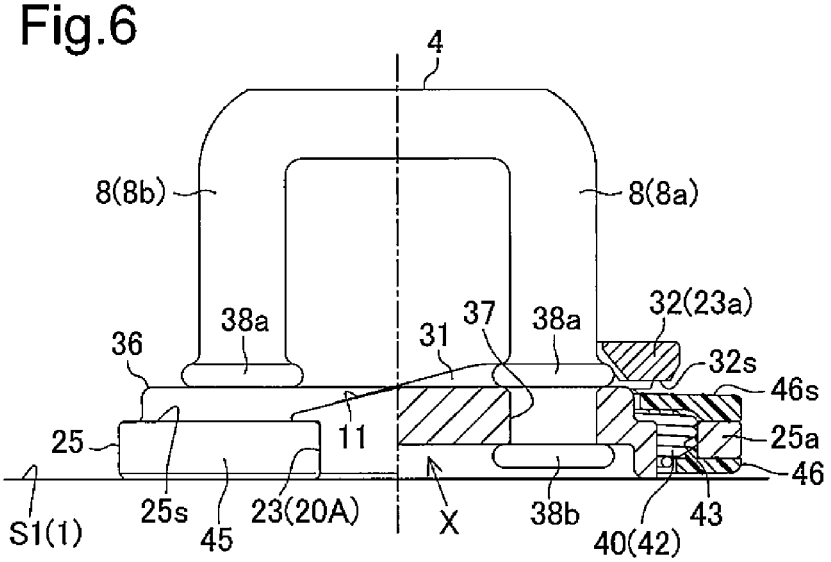
FIG. 6 is a partially cross-sectional view showing the door lock striker, the movable member, the base plate, and the coil cover arranged on the vehicle body panel.

With reference to FIGS. 3 and 6, in the present embodiment, the portion (a projection 36) of the base plate 25 corresponding to the location of the door lock striker 4, which is arranged at the middle position of the base plate 25 in the widthwise direction, has a shape protruding in the projecting direction of the door lock striker 4 (upward as viewed in FIG. 6) compared to the flat surface 25*s*, which configures the slidable surfaces of the bodies 31 of the movable member 23. In this manner, in the present embodiment, the projection 36 of the door lock striker 4 functions as a guide portion for the movable member 23. The door lock striker 4 is projected from the base plate 25 via the projection 36.

Specifically, in the present embodiment, the projection 36 of the base plate 25 has an elongated protrusion-like shape extending in the front-rear direction of the base plate 25 (the horizontal direction as viewed in FIG. 6). The door lock striker 4 is fixed to the base plate 25 with the two leg portions 8 (8*a*, 8*b*) extending through the projection 36.

Specifically, as illustrated in FIG. 6, a clearance X is formed between the projection 36 and the panel surface S1 in the present embodiment. The projection 36 has a through hole 37, in which the two leg portions 8 (8*a*, 8*b*) of the door lock striker 4 are inserted. Two flange-like large diameter portions 38*a*, 38*b* is formed in a basal end portion of each one of the leg portions 8 (8*a*, 8*b*), which are inserted in the through hole 37, at two positions located on opposite sides of the projection 36 in the thickness direction (as viewed in the drawing). In this manner, the door lock striker 4 of the present embodiment is fixed to the vehicle body panel 1 in a state fixed integrally with the base plate 25.

With reference to FIGS. 2, 3, 6, and 7, in the present embodiment, the connecting portion 32, which configures the movable member 23 together with the bodies 31 (31A, 31B) by connecting the rear end portions 31*a* of the bodies 31 (31A, 31B) as has been described, has an arched shape protruding in the projecting direction of the door lock striker 4 (upward as viewed in FIG. 6). In the present embodiment, the arched shape of the connecting portion 32 is substantially an inverted U shape. The connecting portion 32 forms a step. In this manner, when the movable member 23 is moved forward, interference is restrained between the connecting portion 32 and the projection 36 of the base plate 25 and the corresponding leg portion basal end of the door lock striker 4 protruding from the projection 36, or, specifically, the large diameter portion 38*a* formed in the basal end portion of the rear leg portion 8*a*.

Also, in the present embodiment, as illustrated in FIGS. 3 and 5, a cutout 39 is formed in a rear end portion 23*a* of the movable member 23, or, specifically, the rear end portions (the right end portions as viewed in FIG. 5) of the two side wall portions 35 at a position facing the panel surface S1 (a lower position as viewed in the drawing). That is, the movable member 23 has the cutout 39, which is arranged at the position facing the panel surface S1. In this manner, when the movable member 23 is moved rearward, interference is restrained between the rear end portions of the side wall portions 35 and a protruding portion such as a step G formed on the panel surface S1.

Referring to FIG. 4, the movable member 23 of the present embodiment is urged in the direction opposite to the closing direction of the vehicle door 2, which is the direction toward the front side of the base plate 25 (the left side as viewed in the drawing), by the elastic force of the torsion coil spring 40.

Figure 7:
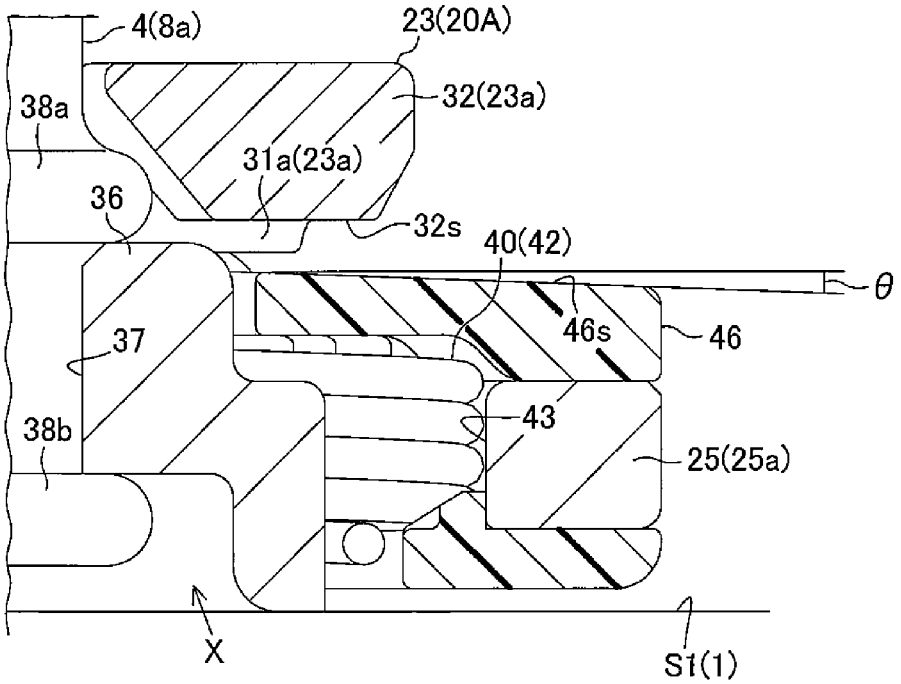
FIG. 7 is a cross-sectional view showing the base plate and the coil cover.

Specifically, the torsion coil spring 40 of the present embodiment has two wound portions 42 (42*a*, 42*b*), which are connected together through a middle linear portion 41. The torsion coil spring 40 is attached to the base plate 25 such that the wound portions 42*a*, 42*b* are spaced apart and arranged on the opposite sides of the rear leg portion 8*a* of the door lock striker 4 in the widthwise direction (the vertical direction as viewed in FIG. 4). As illustrated in FIG. 7, in the present embodiment, the wound portions 42 (and the middle linear portion 41) are accommodated in an accommodating recess (an accommodating hole) 43, which is formed in a middle portion of the base plate 25 in the widthwise direction. As illustrated in FIG. 4, two end portions 44*a*, 44*b*, each of which extends forward from the corresponding one of the wound portions 42*a*, 42*b*, are brought into contact with the bodies 31 (31A, 31B). This causes the torsion coil spring 40 of the present embodiment to urge the movable member 23 forward using the elastic force of the torsion coil spring 40.

In the present embodiment, stopper portions 45 are each formed in a front end portion of a corresponding one of the opposite ends of the base plate 25 in the widthwise direction. Forward movement of the movable member 23 caused by the urging force of the torsion coil spring 40 is restricted at the position where the movable member 23 contacts the stopper portions 45.

As illustrated in FIGS. 2 to 4, 6, and 7, in the present embodiment, a coil cover 46, which covers the wound portions 42 (and the middle linear portion 41) of the torsion coil spring 40 accommodated in the accommodating recess 43, is attached to a rear end portion 25*a* of the base plate 25. In the present embodiment, the base plate 25 and the coil cover 46 configure a base member.

The coil cover 46 of the present embodiment has a rear-portion surface 46*s*, which opposes the movable member 23 that has been moved rearward against the urging force of the torsion coil spring 40 when the coil cover 46 is attached to the rear end portion 25*a* of the base plate 25, as has been described. In the embodiment, as illustrated in FIG. 7, the rear-portion surface 46*s* is inclined such that the closer a location on the rear-portion surface 46*s* is to the rear end (the right side as viewed in the drawing), the shorter the distance is from that location to the panel surface S1 of the vehicle body panel 1.

That is, as the inclined surfaces 11 (11A, 11B) of the movable member 23 are pressed against the inclined surfaces 12 of the fixed member 22, the rear end portion 23*a* becomes inclined toward the vehicle body panel 1 (downward as viewed in FIG. 7). In this manner, the rear end portion 23*a* of the movable member 23, which is moved rearward, or, in other words, the rear end portions 31*a* of the bodies 31 and the connecting portion 32, may come into contact with the rear-portion surface 46*s* of the coil cover 46, which is a decorative surface. This may damage the rear-portion surface 46*s* or cause problems such as scratches or noise.

Particularly, the movable member 23 of the present embodiment is a plastic product molded using a mold. Also, a plastic introducing portion for injection molding of the product is set in a back surface 32*s* of the connecting portion 32, which is the portion that faces the rear-portion surface 46*s* of the coil cover 46 when the movable member 23 is moved rearward. The plastic introducing portion is set at such a position to facilitate the design of the mold and improve the aesthetic appearance of the product. However, consequently, burrs are formed in the material introducing portion (the plastic introducing portion) and further facilitate contact between the rear end portion 23*a* of the movable member 23 and the rear-portion surface 46*s* of the coil cover 46.

To solve this problem, in the present embodiment, the rear-portion surface 46*s* of the coil cover 46 is inclined in the above-described manner (at an inclination angle θ). In this manner, the occurrence of the problems caused by the contact between the rear end portion 23*a* of the movable member 23, which is moved rearward, and the rear-portion surface 46*s* of the coil cover 46 is avoided. Also, a step for removing burrs formed in the plastic introducing portion is eliminated or simplified, thus simplifying the steps of manufacturing the product.

Figure 8:
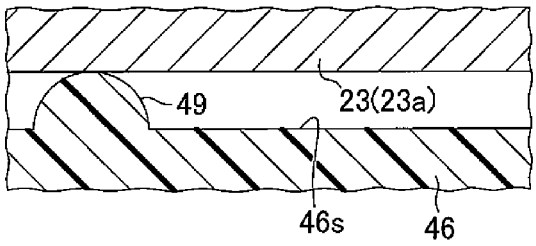
FIG. 8 is a cross-sectional view showing a slidably contacting protrusion arranged on a rear-portion surface of the coil cover.

In the present embodiment, as shown in FIG. 8, two slidably contacting protrusions 49, each of which slidably contacts the rear end portion 23*a* of the movable member 23, are formed on the rear-portion surface 46*s* of the coil cover 46. Specifically, referring to FIG. 2, the slidably contacting protrusions 49 slidably contact the rear end portions 31*a* of the bodies 31 (31A, 31B), which configure the movable member 23. That is, in the present embodiment, by restricting contact portions with respect to the movable member 23 to the slidably contacting protrusions 49, damage to the rear-portion surface 46*s* of the coil cover 46, which is the decorative surface, is avoided. Also, the surface area of such contact is decreased to restrain scratches and noise.

Figure 9:
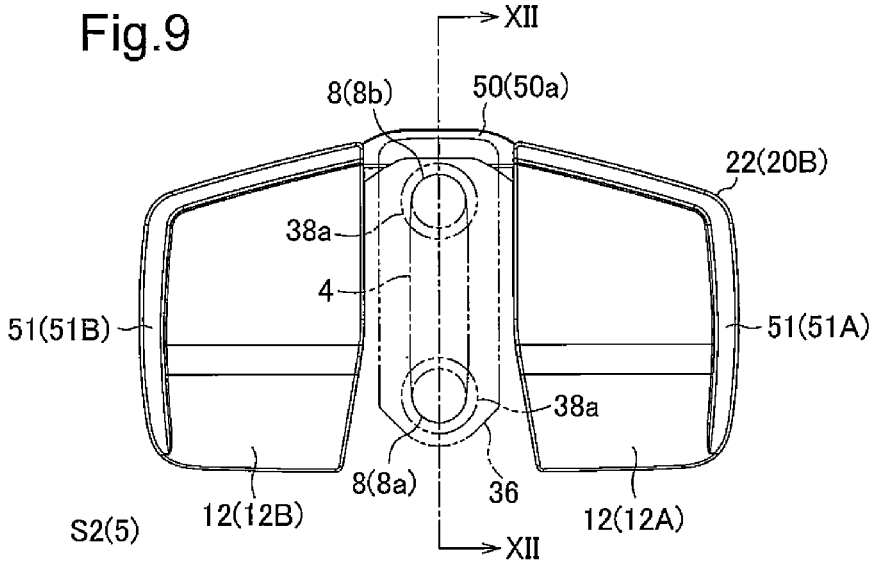
FIG. 9 is a plan view showing a fixed member fixed to a door panel.

As illustrated in FIG. 9, the fixed member 22 of the present embodiment has the two inclined surfaces 12 (12A, 12B), which are moved to positions on the opposite sides of the door lock striker 4 when the vehicle door 2 is closed.

Figure 10:
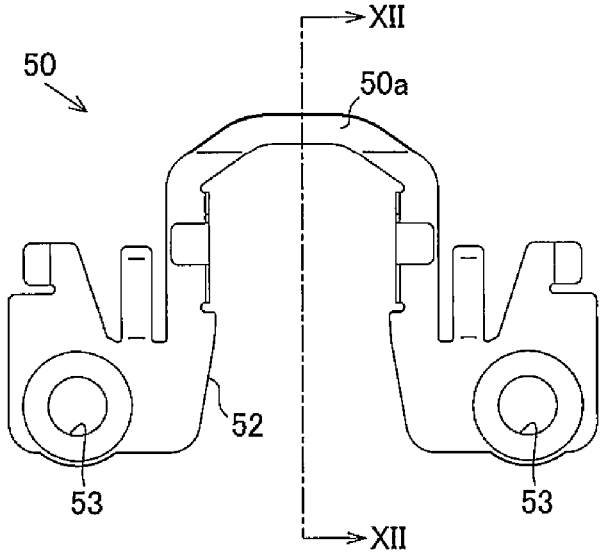
FIG. 10 is a plan view showing a base bracket fixed to the door panel.
Figure 11:
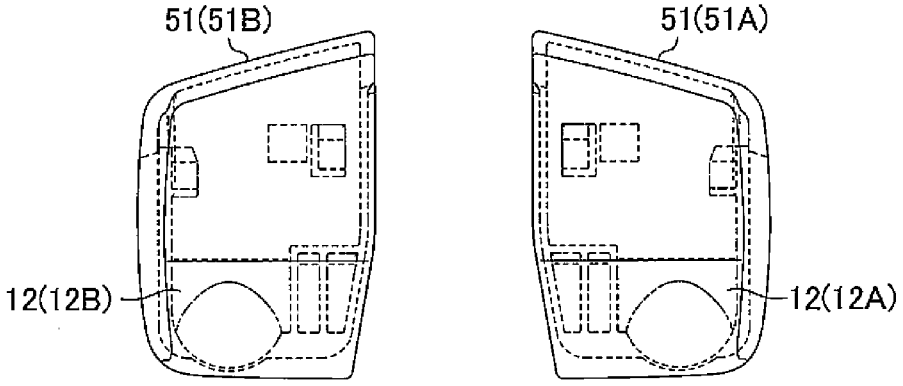
FIG. 11 is a plan view showing the body that configures the fixed member by being fixed to the base bracket.

Specifically, as illustrated in FIGS. 10 and 11, the fixed member 22 of the present embodiment includes a base bracket 50, which is fixed to the panel surface S2 of the door panel 5, and two independent bodies 51 (51A, 51B). The bodies 51 form the inclined surfaces 12 (12A, 12B) by being fixed to the base bracket 50.

With reference to FIG. 10, when the base bracket 50 is fixed to the door panel 5, the direction in which the base bracket 50 is moved relatively in correspondence with opening/closing of the vehicle door 2 (the vertical direction as viewed in the drawing) and the direction perpendicular to this direction (the horizontal direction as viewed in the drawing) are defined as the front-rear direction and the widthwise direction, respectively, of the base bracket 50. In this case, the base bracket 50 has a slit 52, which is arranged at a middle position of the base bracket 50 in the widthwise direction and has an opening facing the front side (the lower side as viewed in FIG. 10). The base bracket 50 is fixed to the panel surface S2 of the door panel 5 such that the striker hole 10 is arranged inside the slit 52.

In the present embodiment, the base bracket 50 is fastened to the door panel 5 using non-illustrated bolts, which are inserted through bolt holes 53 extending through the base bracket 50 in the thickness direction. Also, as illustrated in FIG. 9, the bodies 51 are fixed to the base bracket 50 on the opposite sides of the slit 52 in the widthwise direction with the inclined surfaces 12 (12A, 12B) facing toward the front side (the lower side as viewed in the drawing), or, in other words, in the closing direction of the vehicle door 2. In this manner, in the present embodiment, through relative movement of the door lock striker 4, which is inserted into the striker hole 10 in correspondence with opening/closing of the vehicle door 2 as has been described, into the slit 52, the inclined surfaces 12 (12A, 12B) of the fixed member 22 are moved to positions on the opposite sides of the door lock striker 4.

Figure 12:
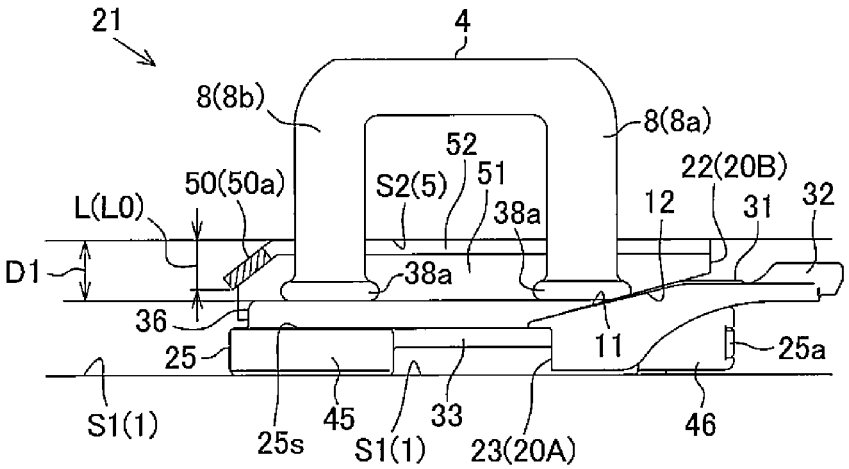
FIG. 12 is an explanatory diagram showing the relationship between the position of the fixed member and the position of the movable member when the vehicle door is closed and the members are arranged to face each other.

With reference to FIG. 12, the base bracket 50 of the present embodiment has a protruding length L by which the base bracket 50 protrudes from the panel surface S2 of the door panel 5. The protruding length L is set smaller than the facing distance D1 between the panel surface S2 and the projection 36 of the door lock striker 4 when the base bracket 50 is moved relatively to the position facing the base plate 25 in the vicinity of the vehicle body panel 1 as the vehicle door 2 is closed. Specifically, the protruding length L0 of the portion arranged apparently on an imaginary line extending from the path of relative movement of each leg portion 8 of the door lock striker 4, which is a slit rear peripheral portion 50*a* arranged on a line that connects the leg portions 8 (8*a*, 8*b*), is set smaller than the aforementioned facing distance D1. In this manner, in the present embodiment, even when the fixed member 22 is moved relatively to the position facing the base plate 25 of the vehicle body panel 1 as the vehicle door 2 is closed, interference between the slit rear peripheral portion 50*a* and the projection 36 of the door lock striker 4 is restrained.

Operation of the fixing device for vehicle doors according to the above described embodiment will now be described.

That is, when the vehicle door 2 is closed, the inclined surfaces 12 (12A, 12B) of the fixed member 22 fixed to the door panel 5 are moved relatively to the positions on the opposite sides of the door lock striker 4, which is arranged on the vehicle body panel 1. The inclined surfaces 12 thus come into contact with the inclined surfaces 11 (11A, 11B) of the movable member 23, which is arranged on the vehicle body panel 1 together with the door lock striker 4. The movable member 23 is then pressed by the fixed member 22 to be moved rearward against the urging force of the torsion coil spring 40, which urges the movable member 23 in the direction in which the inclined surfaces 11 are pressed against the inclined surfaces 12 of the fixed member 22.

At this stage, the vehicle door fixing device 21 of the present embodiment presses the vehicle door 2, which is in a closed state, in the direction crossing the opening/closing direction of the vehicle door 2, which is, specifically, the direction toward the front side (see FIG. 1, the upper side as viewed in the drawing) in which the non-illustrated hinge portion is arranged, using the mutually pressing forces produced between each inclined surface 11 of the movable member 23 and the corresponding inclined surface 12 of the fixed member 22. In this manner, backlash of the vehicle door 2 is restrained. Through such restraint of backlash, the vehicle door 2 is caused to function as a structure (a support member) extending in the front-rear direction of the door opening 3. This improves the rigidity of the vehicle body, thus improving turning performance of the vehicle.

The above described embodiment achieves the following advantages.

(1) The door lock striker 4 includes the leg portions 8 (8*a*, 8*b*), which are projected from the panel surface S1 of the vehicle body panel 1. The movable member 23, which is also arranged on the vehicle body panel 1, includes the two bodies 31 (31A, 31B) each configuring the corresponding inclined surface 11 (11A, 11B), which are arranged at the positions on the opposite sides of the door lock striker 4, and the connecting portion 32, which connects the rear end portions 31*a* of the bodies 31 together. The connecting portion 32 has the arched shape protruding in the projecting direction of each leg portion 8 (8*a*, 8*b*) of the door lock striker 4.

That is, the connecting portion 32, which connects the rear end portions 31*a* of the bodies 31 (31A, 31B) together, moves (forward and rearward) in the front-rear direction integrally with the bodies 31 (31A, 31B) at a position rearward of the leg portion 8 (the rear leg portion 8*a*) of the door lock striker 4, which is projected from the panel surface S1. In many cases, the basal end portion of each leg portion (8*a*, 8*b*) of the door lock striker 4 includes protruding portions such as the fixing portion (the flange-like large diameter portion 28*a*) of the leg portion 8 and the guide portion (the projection 36) of the movable member 23. The movement range of the movable member 23 is set relatively rearward to restrain interference between the connecting portion 32 and the protruding portions when the movable member 23 is moved forward. This disadvantageously enlarges the area necessary for installing the movable member 23 in the vehicle body panel 1.

However, in this configuration, even when the movable member 23 is moved forward, it is unlikely that the connecting portion 32 will interfere with the protruding portions (the large diameter portion 28*a* and the projection 36), which are formed in the basal end portion of the leg portion 8 (the rear leg portion 8*a*) of the door lock striker 4. This allows the movement range of the movable member 23 to be set relatively forward, thus reducing the size of the area necessary for installing the movable member 23. As a result, the usability of the device is widened such that the device can be employed in a greater number of types of vehicles.

(2) The movable member 23 is urged in the direction in which the inclined surfaces 11 (11A, 11B) are pressed against the inclined surfaces 12 (12A, 12B) of the fixed member 22 by the elastic force of the torsion coil spring 40. The torsion coil spring 40 includes the two wound portions 42, which are adapted to be spaced apart and arranged on the opposite sides of the corresponding leg portion 8 of the door lock striker 4.

This configuration reduces the size of the area necessary for installing the movable member 23, including the area for the torsion coil spring 40, which configures an urging member. This widens the usability of the device such that the device can be used in a greater number of types of vehicles.

(3) The cutout 39 is formed in the rear end portion 23*a* of the movable member 23 (the rear end portions of the two side wall portions 35) at the position facing the panel surface S1. This makes it unlikely that the rear end portion 23*a* will interfere with the protruding portions formed on the panel surface S1, including the step G, when the movable member 23 is moved rearward. The area necessary for installing the movable member 23 is thus reduced in size. This widens the usability of the device such that the device can be used in a greater number of types of vehicles.

(4) The movable member 23 is slidably arranged on the base plate 25, which is fixed to the panel surface S1 of the vehicle body panel 1. The coil cover 46, which covers the two wound portions 42 (and the middle linear portion 41) of the torsion coil spring 40, is attached to the rear end portion 25*a* of the base plate 25. The rear-portion surface 46*s*, which configures the decorative surface of the coil cover 46, is inclined such that the closer a location on the rear-portion surface 46*s* is to the rear end (the right side as viewed in the drawing), the shorter the distance is from that location to the panel surface S1 of the vehicle body panel 1.

That is, when the inclined surfaces 11 of the movable member 23 are pressed against the inclined surfaces 12 of the fixed member 22, the rear end portion 23*a* becomes inclined toward the vehicle body panel 1. In this manner, the rear end portion 23*a* of the movable member 23, which is moved rearward, or, in other words, the rear end portions 31*a* of the bodies 31 and the connecting portion 32, may contact the rear-portion surface 46*s* of the coil cover 46, which is the decorative surface. This may damage the rear-portion surface 46*s* or cause problems such as starches and noise.

However, the above-described configuration makes it unlikely that the rear end portion 23*a* of the movable member 23, which is moved rearward, will contact the rear-portion surface 46*s* of the coil cover 46. In this manner, the problems caused by such contact are avoided.

(5) The two inclined surfaces 12 (12A, 12B) are moved to the positions on the opposite sides of the door lock striker 4 when the vehicle door 2 is closed. The fixed member 22 includes the base bracket 50, which is fixed to the panel surface S2 of the door panel 5, and the two independent bodies 51 (51A, 51B), which form the inclined surfaces 12 (12A, 12B) by being fixed to the base bracket 50.

This configuration facilitates reduction of the protruding length L0 of the portion arranged apparently on the imaginary line extending from the path of relative movement of each leg portion 8 of the door lock striker 4, which is the slit rear peripheral portion 50*a* arranged on the line that connects the leg portions 8 (8*a*, 8*b*). This makes it unlikely that the slit rear peripheral portion 50*a* will interfere with the protruding portion (the projection 36) formed on the basal end portions of the leg portions 8 (8*a*, 8*b*) of the door lock striker 4. The dimension of the fixed member 22 in the direction in which the fixed member 22 is moved relatively is thus decreased. As a result, the area necessary for installing the fixed member 22 is reduced in size. This widens the usability of the device such that the device can be used in a greater number of types of vehicles.

The above illustrated embodiment may be modified as follows.

Figure 13:
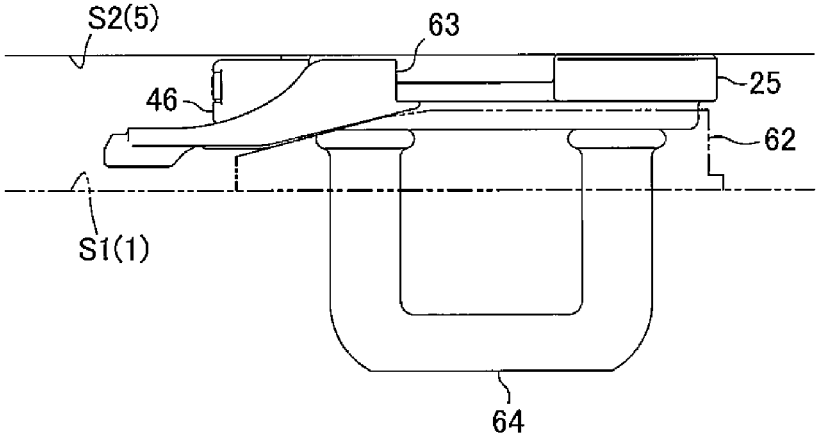
FIG. 13 is an explanatory diagram representing a modification regarding the arrangement of the door lock striker, the movable member, and the fixed member.

In the above illustrated embodiment, the door lock striker 4 and the movable member 23 are arranged on the vehicle body panel 1 and the fixed member 22 is provided on the door panel 5. However, the present invention is not restricted to this. As illustrated in FIG. 13, a fixed member 62 may be arranged on the vehicle body panel 1 and a movable member 63 and a door lock striker 64 may be provided on the door panel 5.

The above illustrated embodiment is the vehicle door fixing device 21 used in the vehicle door 2, or, specifically, the right side door of the vehicle, which is selectively opened and closed about the hinge portion as the action pivot. However, the present invention is not restricted to this but may be employed in a sliding door. Alternatively, the invention may be used in a tail door, which selectively opens and closes an opening at the tail of a vehicle.

In the above illustrated embodiment, the cutout 39 is formed in the rear end portion 23*a* of the movable member 23 at the position facing the panel surface S1. However, the shape of the rear end portion 23*a* with the cutout is not particularly restricted to the shape of the embodiment. That is, although the cutout is formed in the rear end portions of the two side wall portions 35 in the above illustrated embodiment, the present invention is not restricted to this. The portion of each body 31 (31A, 31B) facing the panel surface S1, for example, may have a cutout.

In the above illustrated embodiment, the base plate 25 and the coil cover 46, which is attached to the rear end portion 25*a* of the base plate 25, configure the base member. However, the present invention is not restricted to this. The base member may be formed by a single member. Further, regarding issues unrelated to the base member, a configuration is acceptable in which the door lock striker 4 is projected directly from the panel surface S1.

In the above illustrated embodiment, the two slidably contacting protrusions 49, which slidably contact the rear end portions 31*a* of the bodies 31 (31A, 31B) configuring the movable member 23, are formed on the rear-portion surface 46*s* of the coil cover 46. However, the number and locations of the slidably contacting protrusions 49 may be changed as needed.

In the above illustrated embodiment, the movable member 23 is a plastic product molded using a mold. The plastic introducing portion used in injection molding is set in the back surface 32*s* of the connecting portion 32. However, the present invention is not restricted to this. The movable member 23 does not necessarily have to be a molded plastic product but may be formed through aluminum die casting, for example. Also, the plastic introducing portion for the injection molding is not restricted to the plastic introducing portion of the above illustrated embodiment.

Although the arched shape of the connecting portion 32 is substantially an inverted U shape in the above illustrated embodiment, the arched shape of the connecting portion 32 is not restricted to this shape but may be changed as needed. The connecting portion 32 may have a curved shape such as an arcuate shape.

In the above illustrated embodiment, the protruding length L0 of the slit rear peripheral portion 50*a* of the base bracket 50 configuring the fixed member 22 is set smaller than the aforementioned facing distance D1 between the panel surface S2 and the projection 36 of the door lock striker 4. In this manner, even when the fixed member 22 is moved relatively to the position facing the base plate 25 in the vicinity of the vehicle body panel 1 as the vehicle door 2 is closed, interference between the slit rear peripheral portion 50*a* and the projection 36 of the door lock striker 4 is restrained. However, the present invention is not restricted to this and the protruding length L0 of the slit rear peripheral portion 50*a* may be set to restrain interference with the large diameter portion 38*a* of the front leg portion 8*b*, which protrudes from the projection 36.

The bodies 51 (51A, 51B), which configure the fixed member 22, may be configured such that the bodies 51 are pivotal about a fixed shaft with respect to the base bracket 50. This configuration causes the inclined surfaces 12 (12A, 12B) of the bodies 51, which configure the fixed member 22, to move in a manner following the inclined surfaces 11 (11A, 11B) of the bodies 31 of the movable member 23, with which the inclined surfaces 12 come into contact when the vehicle door 2 is closed. As a result, the vehicle door 2 is reliably held with improved effectiveness using the forces by which the inclined surfaces 11, 12 are pressed against each other.

Next, the technical ideas obtainable from the above embodiments are described below with their advantages.

(1) A fixing device for vehicle doors, comprising:

a door lock striker adapted to be arranged on a first panel that is one of a vehicle body panel and a door panel;

a fixed member adapted to be fixed to a second panel that is the other one of the vehicle body panel and the door panel, wherein the fixed member has two inclined surfaces that are movable relative to the door lock striker on opposite sides of the door lock striker;

a movable member adapted to be arranged on the first panel, wherein the movable member has two inclined surfaces arranged on opposite sides of the door lock striker, and the inclined surfaces are urged to be pressed against the inclined surfaces of the fixed member; and a base member adapted to be fixed to a panel surface of the first panel, wherein the movable member is adapted to be slidable on the base member, and the base member has a rear-portion surface that faces the movable member by being pressed and moved rearward by the fixed member, wherein the rear-portion surface is inclined such that the closer a location on the rear-portion surface is to the rear end, the shorter the distance is from that location to the surface of the first panel.

(2) The fixing device for vehicle doors according to item (1), wherein the movable member is a product molded using a mold, the movable member has a material introducing portion for molding in a portion that faces the rear-portion surface when the movable member is moved rearward.

That is, burrs formed in the material introducing portion further facilitate contact between the portion that faces the rear-portion surface of the base member and the rear-portion surface of the base member. Therefore, by employing the present invention in this configuration, a more significant effect is ensured. Also, by eliminating or simplifying the step for removing burrs, the steps for manufacturing the device are simplified.

(3) The fixing device for vehicle doors according to item (2), wherein the portion of the movable member in which the material introducing portion is formed has an arched shape protruding in a direction separating away the rear-portion surface.

In this configuration, it is unlikely that the portion in which the material introducing portion for molding is formed will contact the rear-portion surface of the base member. This restrains problems caused by such contact, thus improving the product marketability.

(4) The fixing device for vehicle doors according to any one of items (1) to (3), further comprising a slidably contacting protrusion that is arranged on the rear-portion surface and slidably contacts the movable member.

In this configuration, the portion that contacts the movable member is restricted to the slidably contacting protrusion. In this manner, damage to the rear-portion surface, which is a decorative surface, is avoided. Further, since the contact surface area is decreased, occurrence of scratches and noise is restrained.

(5) The fixing device for vehicle doors according to item (3), wherein the door lock striker includes a leg portion that has a large diameter portion at a basal end and is projected, and the arched shape of the connecting portion is a shape that allows the connecting portion to avoid contact with the large diameter portion.

(6) The fixing device for vehicle doors according to item (3), wherein the door lock striker further includes a base member adapted to be fixed to the panel surface of the first panel, the door lock striker has a projection arranged on the base member, the door lock striker is projected from the base member via the projection, the movable member is adapted to be slidable on the base member, the projection of the door lock striker protrudes from a slidable surface of the movable member, and the arched shape of the connecting portion is a shape that allows the connecting portion to avoid contact with the projection of the door lock striker.

(7) The fixing device for vehicle doors according to item (6), wherein the fixed member includes a base bracket adapted to be fixed to a panel surface of the second panel, a protruding length of the base bracket from the panel surface of the second panel is set smaller than the facing distance between the panel surface of the second panel and the projection of the door lock striker.

(8) A fixing device for vehicle doors, comprising:

a door lock striker adapted to be arranged on a first panel that is one of a vehicle body panel and a door panel;

a fixed member adapted to be fixed to a second panel that is the other one of the vehicle body panel and the door panel, wherein the fixed member has two inclined surfaces that are movable relative to the door lock striker on opposite sides of the door lock striker;

a movable member adapted to be arranged on the first panel, wherein the movable member has two inclined surfaces arranged on opposite sides of the door lock striker, and the inclined surfaces are urged to be pressed against the inclined surfaces of the fixed member;

a base member adapted to be fixed to a panel surface of the first panel; and a torsion coil spring that urges the movable member in a direction in which the movable member is pressed against the fixed member, wherein the door lock striker includes a leg portion projected from the panel surface of the first panel, and the torsion coil spring has two wound portions that are adapted to be spaced apart and arranged on opposite sides of the leg portion.

The invention claimed is:

1. A fixing device for vehicle doors, comprising:

a door lock striker adapted to be arranged on a first panel that is one of a vehicle body panel and a door panel;

a fixed member adapted to be fixed to a second panel that is the other one of the vehicle body panel and the door panel, wherein the fixed member has two inclined surfaces that are positionable on opposite sides of the door lock striker when the door lock striker is received in the fixed member;

a movable member adapted to be arranged on the first panel, wherein the movable member has two inclined surfaces arranged on opposite sides of the door lock striker, and the inclined surfaces are urged to be pressed against the inclined surfaces of the fixed member; and a base member adapted to be fixed to a panel surface of the first panel, wherein the movable member is adapted to be slidable on the base member;

the door lock striker includes a leg portion projected from the panel surface of the first panel, the movable member includes two bodies configuring the two inclined surfaces of the movable member and a connecting portion that connects the bodies together at rear end portions of the bodies that are pressed against the fixed member and moved rearward, the connecting portion has an arched shape protruding in a direction in which the leg portion is projected, and the door lock striker and the movable member are movable relative to each other.

2. The fixing device for vehicle doors according to claim 1, further comprising a torsion coil spring that urges the movable member in a direction in which the movable member is pressed against the fixed member, wherein the torsion coil spring has two wound portions that are adapted to be spaced apart and arranged on opposite sides of the leg portion.

3. The fixing device for vehicle doors according to claim 1, wherein the movable member has a cutout arranged in a portion of the rear end portion facing the panel surface of the first panel.

4. The fixing device for vehicle doors according to claim 1, wherein the base member has a rear-portion surface that faces the movable member when the movable member is moved rearward, wherein the rear-portion surface is inclined such that the closer a location on the rear-portion surface is to the rear end, the shorter the distance is from that location to the panel surface of the first panel.

5. The fixing device for vehicle doors according to claim 4, wherein the movable member is a product molded using a mold and has a material introducing portion for molding in a portion that faces the rear-portion surface when the movable member is moved rearward.

6. The fixing device for vehicle doors according to claim 5, wherein the portion of the movable member in which the material introducing portion is formed has an arched shape protruding in a direction away from the rear-portion surface.

7. The fixing device for vehicle doors according to claim 4, further comprising a slidably contacting protrusion that is arranged on the rear-portion surface and slidably contacts the movable member.

8. The fixing device for vehicle doors according to claim 1, wherein the fixed member includes a base bracket adapted to be fixed to a panel surface of the second panel and two independent bodies that are fixed to the base bracket and form the two inclined surfaces of the fixed member.

9. The fixing device for vehicle doors according to claim 8, wherein a protruding length of the base bracket from the panel surface of the second panel is set smaller than the facing distance between the panel surface of the second panel and a projection of the door lock striker.

10. The fixing device for vehicle doors according to claim 1, wherein the leg portion of the door lock striker has a large diameter portion at a basal end, and the arched shape of the connecting portion is a shape that allows the connecting portion to avoid contact with the large diameter portion.

11. The fixing device for vehicle doors according to claim 1, further comprising a base member adapted to be fixed to the panel surface of the first panel, wherein the door lock striker has a projection arranged on the base member, the door lock striker is projected from the base member via the projection, the movable member is adapted to be slidable on the base member, the projection of the door lock striker protrudes from a slidable surface of the movable member, and the arched shape of the connecting portion is a shape that allows the connecting portion to avoid contact with the projection of the door lock striker.

12. The fixing device for vehicle doors according to claim 1, wherein the inclined surfaces of the movable member are pressed against the inclined surfaces of the fixed member in a running direction of the vehicle.

13. A fixing device for vehicle doors, comprising:

a door lock striker adapted to be arranged on a first panel that is one of a vehicle body panel and a door panel;

a fixed member adapted to be fixed to a second panel that is the other one of the vehicle body panel and the door panel, wherein the fixed member has two inclined surfaces that are positionable on opposite sides of the door lock striker when the door lock striker is received in the fixed member; and a movable member adapted to be arranged on the first panel, wherein the movable member has two inclined surfaces arranged on opposite sides of the door lock striker, and the inclined surfaces are urged to be pressed against the inclined surfaces of the fixed member, wherein the door lock striker includes a leg portion projected from a panel surface of the first panel, the movable member includes two bodies configuring the two inclined surfaces of the movable member and a connecting portion that connects the bodies together at rear end portions of the bodies that are pressed against the fixed member and moved rearward, the connecting portion has an arched shape protruding in a direction in which the leg portion is projected, the fixing device further comprises a torsion coil spring that urges the movable member in a direction in which the movable member is pressed against the fixed member, and the torsion coil spring has two wound portions that are adapted to be spaced apart and arranged on opposite sides of the leg portion.

* * * * *